US007325942B2

(12) United States Patent
Chang

(10) Patent No.: US 7,325,942 B2
(45) Date of Patent: Feb. 5, 2008

(54) BULB ASSEMBLY WITH A DECORATIVE COVER

(76) Inventor: Hsiu-Tsen Chang, 2F-1, No. 152, Nan Yar Street, Hsinchu City (TW)

( * ) Notice: Subject to any disclaimer, the term of this patent is extended or adjusted under 35 U.S.C. 154(b) by 0 days.

(21) Appl. No.: 11/326,477

(22) Filed: Jan. 6, 2006

(65) Prior Publication Data

US 2007/0159824 A1 Jul. 12, 2007

(51) Int. Cl.
*F21V 33/00* (2006.01)

(52) U.S. Cl. ..... 362/235; 362/249; 362/363; 362/649; 362/806; 362/807; 362/122

(58) Field of Classification Search ..... 362/121, 362/122, 123, 249, 363, 391, 237, 647, 649, 362/652, 653, 654, 807, 806, 808; D26/1–4
See application file for complete search history.

(56) References Cited

U.S. PATENT DOCUMENTS 1,728,547 A * 9/1929 Herweg ..... 362/566
4,783,726 A * 11/1988 Wang ..... 362/252
6,394,620 B1 * 5/2002 Wang ..... 362/121

* cited by examiner

*Primary Examiner*—Thomas M. Sember
(74) *Attorney, Agent, or Firm*—Rosenberg, Klein & Lee

(57) ABSTRACT

The invention relates to a bulb assembly with a decorative cover. The bulb assembly includes a shell, a holder, and a bulb, and the decorative cover can be connected with the bulb assembly by special positioning structure. The decorative cover has several branches with different surface planes and is transparent. As the bulb is lightened, the ray passes through the branches of the cover that displays a special lighting effect.

3 Claims, 7 Drawing Sheets

BULB ASSEMBLY WITH A DECORATIVE COVER

BACKGROUND OF THE INVENTION

A conventional bulb assembly includes a shell, a holder, and a bulb, which is connected on a light string for decorative effect. The known structure is simple and monologue. Each bulb emits light outward directly without any novelty. Thus, the conventional bulb assembly should be improved.

The present invention is to provide a bulb assembly with a decorative cover, which provides a special decorative effect and is better than ever. Now, accompanying with the following drawings, the character of the present invention will be described here and after.

DETAILED DESCRIPTION OF THE PREFERRED EMBODIMENT

Figure 1:
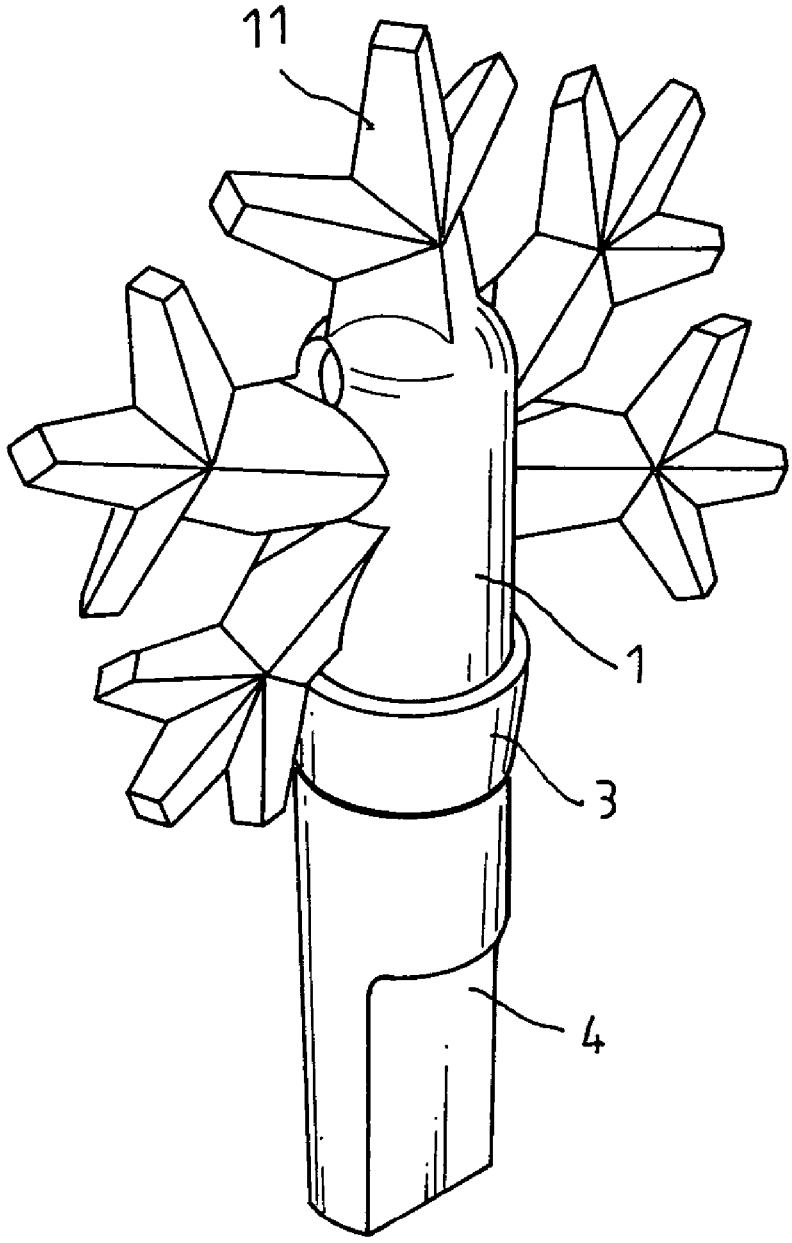
FIG. 1 is a perspective view showing a bulb assembly with a decorative cover according to the present invention.
Figure 2:
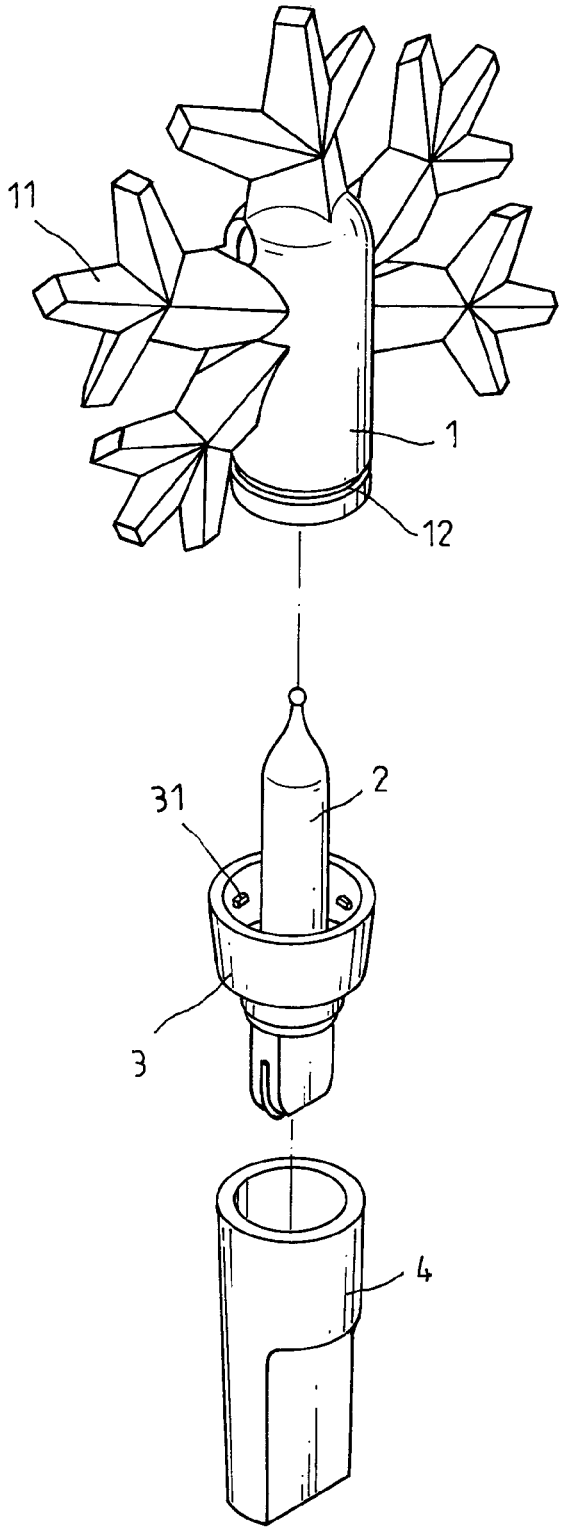
FIG. 2 is an exploded perspective view of FIG. 1.
Figure 3:
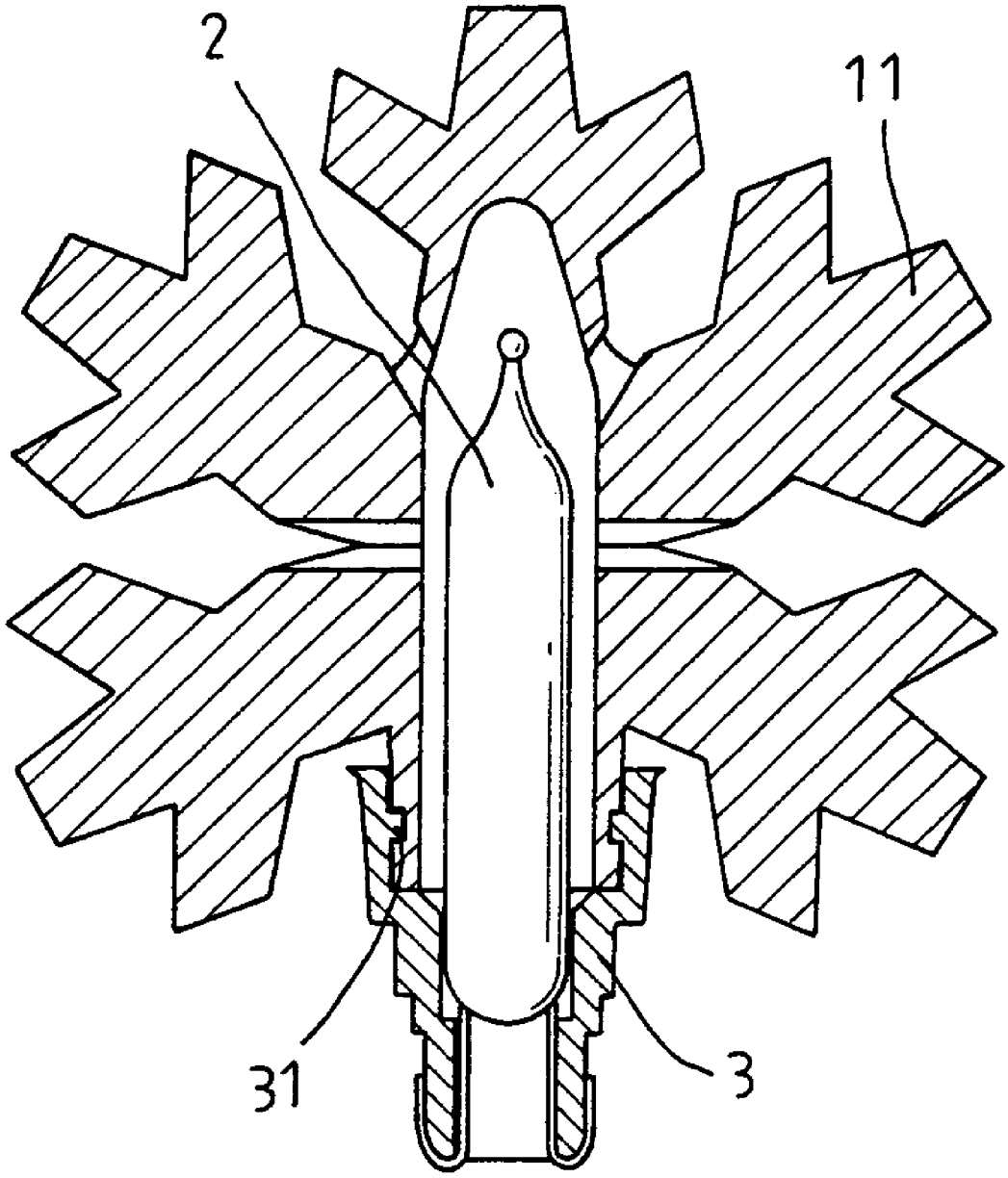
FIG. 3 is a cross-sectional plan view of FIG. 1.

Referring to FIG. 1 to 3, the present invention relates to a connecting structure of a bulb assembly and a decorative cover (1). The bulb assembly is provided on a light string and includes a shell (4), a holder (3), and a bulb (2). The holder (3) has several projections (31) formed in its upper inner base. The decorative cover (1) made of transparent material has several branches (11), each of which has different surface planes. The decorative cover (1) has a lower annual groove (12). When the decorative cover (1) connects with the holder (3), the projections (31) are placed in the annual groove (12) that obtains a secure connection between both, while the cover (1) can still rotate on the bulb assembly and will not separate.

In use, when the bulb (3) is on, it emits light, which passes through each branches (11) of the cover (1) and produces diffusing effect that makes a shining and beautiful outlook just as a diamond. Hence, the light string connecting with the bulb assemblies having the decorative covers can obtain a unique and better decorative effect than any prior structure.

It is also to be understood that the above-mentioned embodiments are only exemplary of the present invention.

Figure 4:
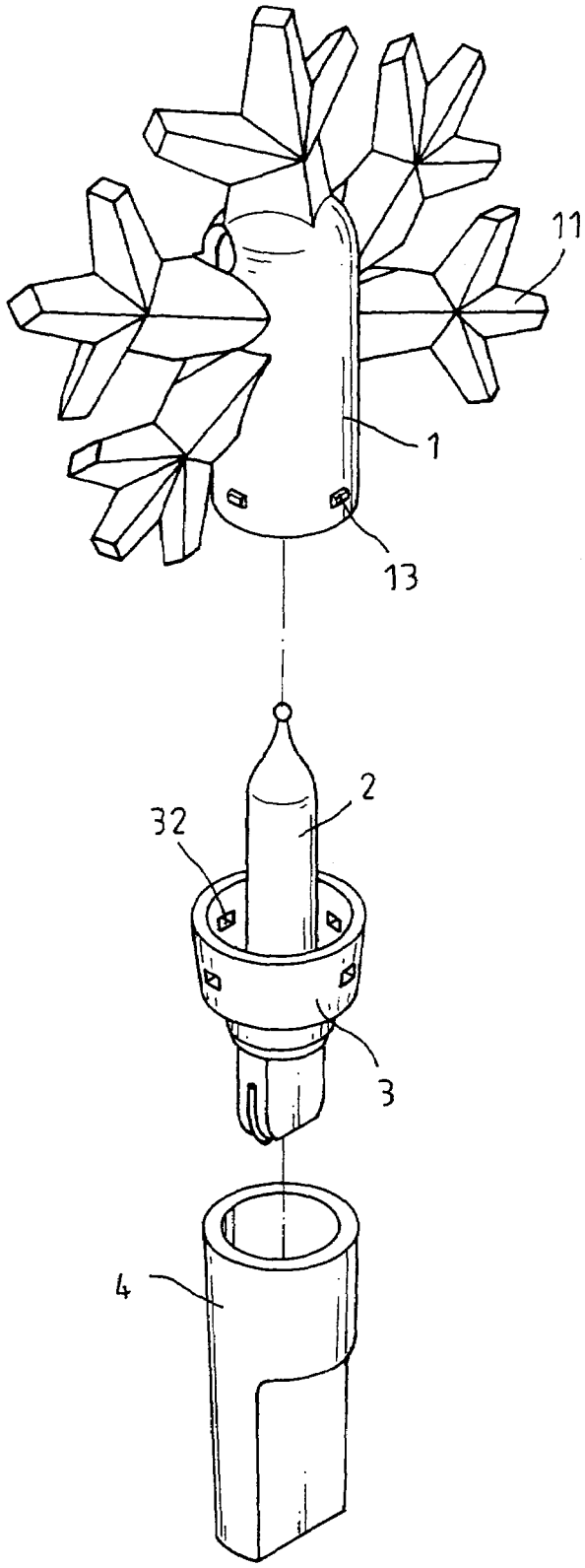
FIG. 4 is a perspective view showing a modified bulb assembly with a decorative cover according to the present invention.
Figure 5:
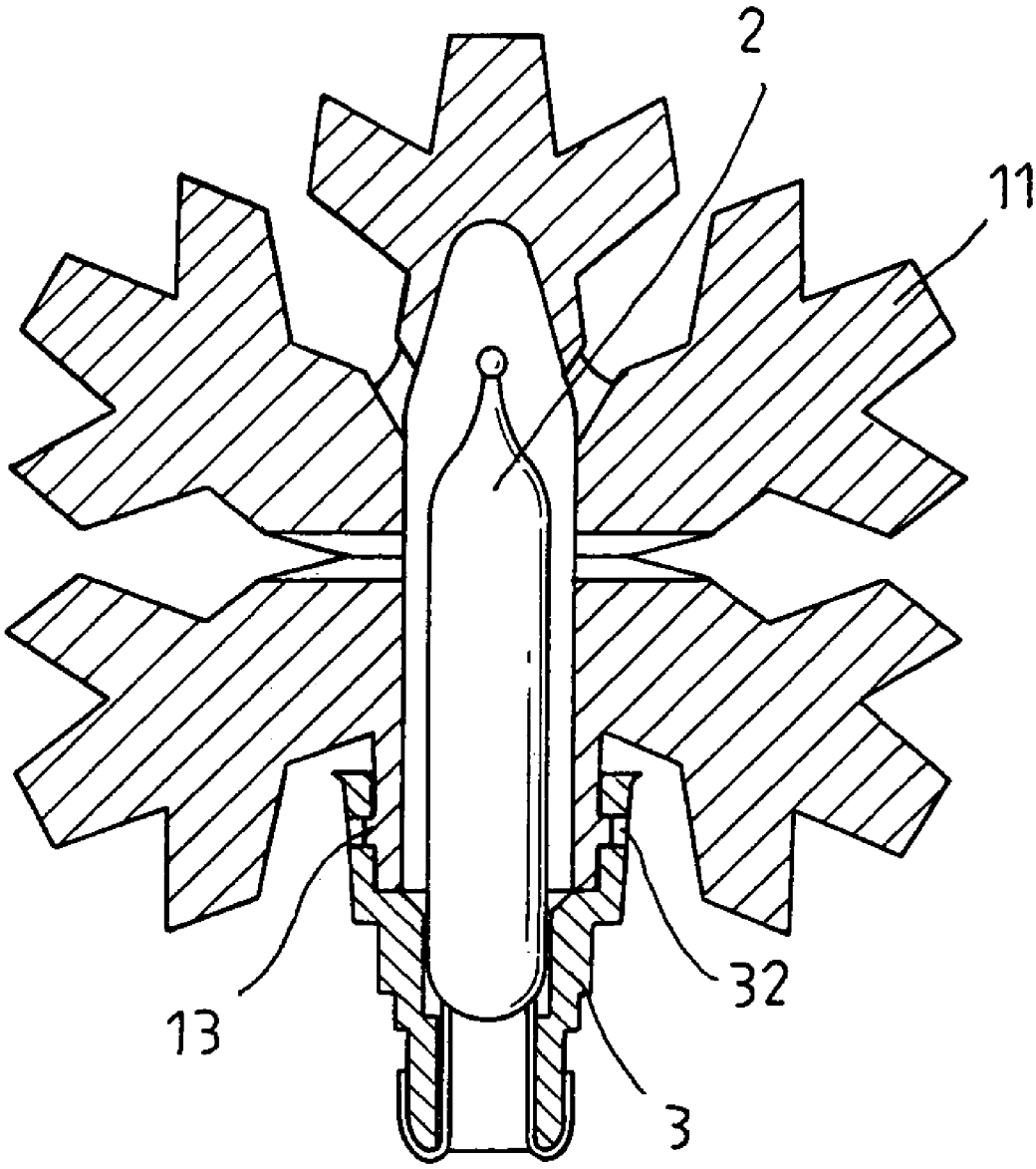
FIG. 5 is a cross-sectional plan view of FIG. 4.
Figure 6:
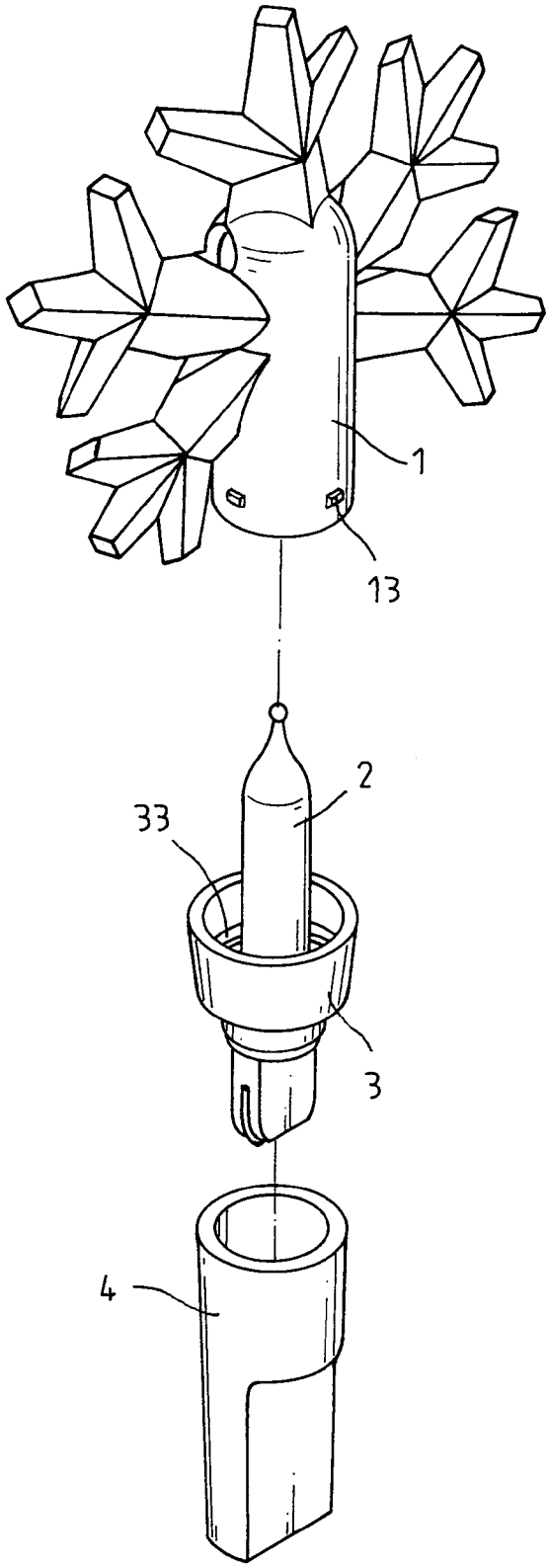
FIG. 6 is a perspective view showing another modified bulb assembly with a decorative cover according to the present invention.
Figure 7:
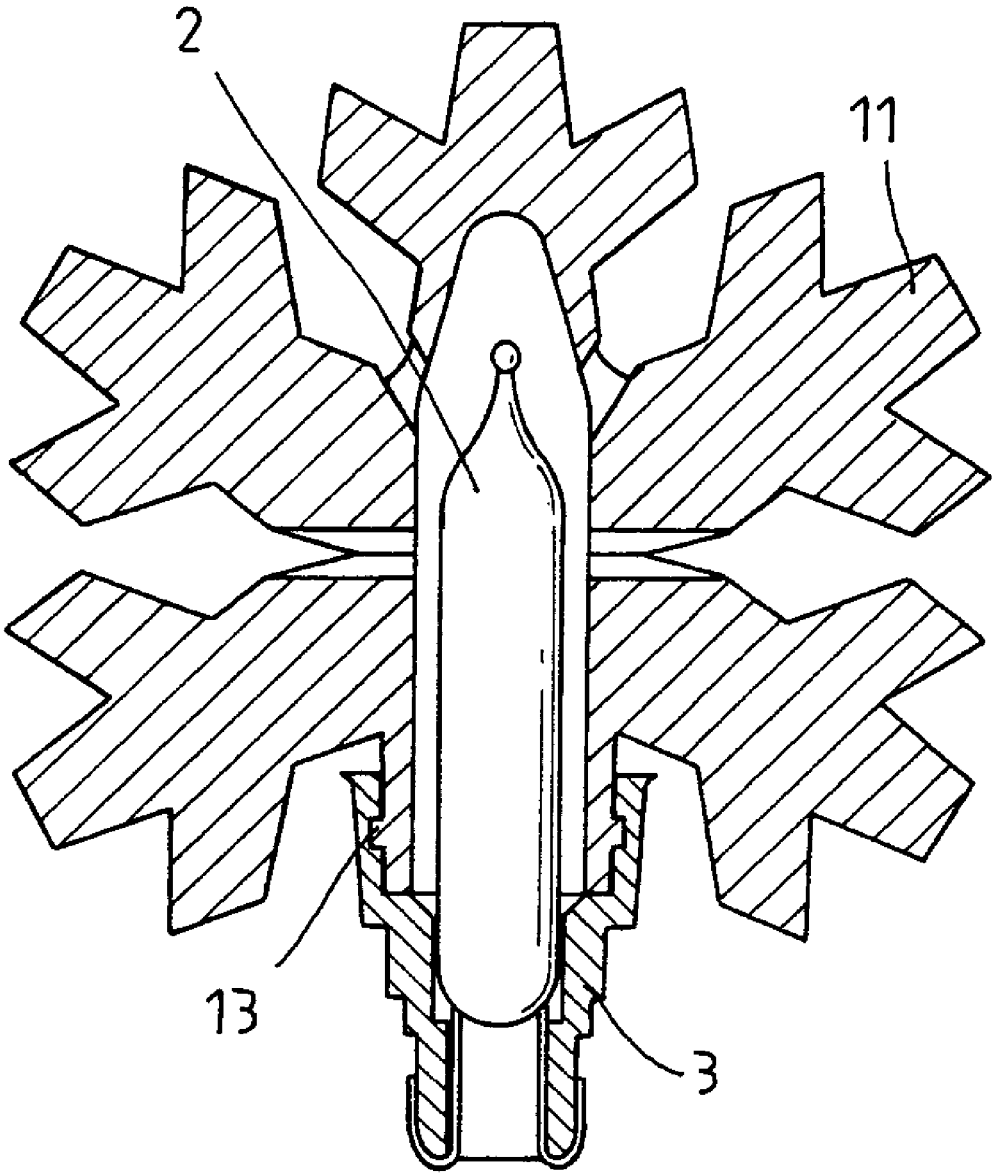
FIG. 7 is a cross-sectional plan view of FIG. 6.

Any modification with the same or similar merit is still claimed in this application, such as shown in FIGS. 4 and 5, a modified bulb assembly with a decorative cover is shown, wherein the cover (1) has its lower end several projections (13) and the holder (3) has several grooves (32) on its upper base. When the cover (1) connects with the holder (3), each projection (13) is engaged with a related groove (32) that the cover (1) is then connected with bulb assembly firmly. Referring to FIGS. 6 and 7, it shows another modified embodiment according to above structure, wherein the holder (3) has an annual groove (33) formed in its upper base. When the cover (1) connects with the holder (3), the projections (13) are placed in the groove (33) that the cover (1) can still rotate on the bulb assembly and will not separate from the bulb assembly.

Accordingly, the present invention obtains utilization and improvement and should be allowed for patent.

I claim:

1. A bulb assembly with a decorative cover comprising:

a shell having a cavity formed therein;

a holder including a bulb and having at least one projection formed on an inner surface thereof, said holder being received in said cavity of said shell;

a rotatable transparent cover having a lower end thereof received in said holder and including a plurality of integrally formed branch members, each respective one of said plurality of branch members having different surface planes; and an annular groove formed on said lower end of said rotatable transparent cover for receiving said at least one projection of said holder when said lower end of said rotatable transparent cover is received in said holder.

2. The bulb assembly with a decorative cover as claimed in claim 1, wherein every bulb assembly connected on a light string connects with a related decorative cover.

3. A bulb assembly with a decorative cover comprising:

a shell having a cavity formed therein;

a holder including a bulb and being received in said cavity of said shell;

a rotatable transparent cover having a lower end thereof received in said holder and including a plurality of integrally formed branch members, each respective one of said plurality of branch members having different surface planes, said rotatable transparent cover having at least one projection formed on said lower end thereof; and an annular groove formed on an inner surface of said holder for receiving said at least one projection of said rotatable transparent cover when said lower end of said rotatable transparent cover is received in said holder.

* * * * *